US011185972B2

(12) United States Patent
He et al.

(10) Patent No.: US 11,185,972 B2
(45) Date of Patent: Nov. 30, 2021

(54) TELESCOPIC ALUMINUM ROD

(71) Applicant: NINGBO DONGCHUAN SWIMMING POOL EQUIPMENT CO., LTD., Ningbo (CN)

(72) Inventors: Huaizhong He, Ningbo (CN); Hu Zhang, Ningbo (CN)

(73) Assignee: NINGBO DONGCHUAN SWIMMING POOL EQUIPMENT CO., LTD., Ningbo (CN)

( * ) Notice: Subject to any disclaimer, the term of this patent is extended or adjusted under 35 U.S.C. 154(b) by 217 days.

(21) Appl. No.: 16/725,733

(22) Filed: Dec. 23, 2019

(65) Prior Publication Data

US 2020/0215681 A1 Jul. 9, 2020

(30) Foreign Application Priority Data

Jan. 3, 2019 (CN) ..... 201920006431.7

(51) Int. Cl.
*B25G 1/04* (2006.01)
*E04H 4/16* (2006.01)

(52) U.S. Cl.
CPC . *B25G 1/04* (2013.01); *E04H 4/16* (2013.01)

(58) Field of Classification Search
CPC ..... B25G 1/04
See application file for complete search history.

(56) References Cited

U.S. PATENT DOCUMENTS 3,882,569 A * 5/1975 Vanderveer ..... F16B 7/0433 16/427
4,181,230 A * 1/1980 Acuff ..... A47F 5/13 211/183
4,247,216 A * 1/1981 Pansini ..... B25G 3/18 15/1.7
5,301,378 A * 4/1994 Schultz ..... B25F 1/00 7/158
5,729,865 A * 3/1998 Stoddart ..... B05C 17/0205 16/429
5,779,386 A * 7/1998 Eichhorn ..... A47D 13/105 403/109.3
6,311,368 B1 * 11/2001 Sartori ..... B25G 1/04 15/144.3
6,435,754 B1 * 8/2002 Canale ..... F16L 27/1273 403/109.2
6,832,784 B1 * 12/2004 Chen ..... A47L 9/244 285/303
7,334,957 B2 * 2/2008 Sadinsky ..... E04H 12/2269 403/109.3

(Continued)

*Primary Examiner* — Jason W San
(74) *Attorney, Agent, or Firm* — W&KIP

(57) ABSTRACT

The present disclosure discloses a telescopic aluminum rod comprising at least two nested aluminum tubes and except the innermost aluminum tube, the rear ends of the rest aluminum tubes are respectively connected with a sleeve; each sleeve is internally provided with an accommodating cavity in which a locking device is arranged; the locking device comprises a pressing buckle which is longitudinally movably mounted in the accommodating cavity and the upper end face of the pressing buckle protrudes out of the sleeve through an opening formed on the sleeve, a bent plate of which the rear end abuts against the lower end face of the pressing buckle, and the middle is clamped inside the accommodating cavity.

14 Claims, 8 Drawing Sheets

(56) References Cited

U.S. PATENT DOCUMENTS

| | | | | |
|---|---|---|---|---|
| 7,896,398 | B2 * | 3/2011 | Suda | B25G 1/04 285/7 |
| 10,441,120 | B1 * | 10/2019 | Sgroi, Jr. | B25G 1/04 |
| 10,729,955 | B2 * | 8/2020 | Knutson | A63B 53/10 |
| 2003/0007830 | A1 * | 1/2003 | Bang | F16B 7/042 403/327 |
| 2003/0184104 | A1 * | 10/2003 | Ping | A01B 1/022 294/57 |
| 2003/0235463 | A1 * | 12/2003 | Neumann | B25G 3/18 403/329 |
| 2005/0285387 | A1 * | 12/2005 | Suda | B25G 1/04 285/7 |
| 2013/0234458 | A1 * | 9/2013 | Wilkins | B25G 1/04 294/3.6 |
| 2014/0064842 | A1 * | 3/2014 | Lin | F16B 7/105 403/379.5 |
| 2014/0138280 | A1 * | 5/2014 | Meinzer | B25G 3/18 206/577 |
| 2017/0300730 | A1 * | 10/2017 | Kamel | B25G 1/04 |
| 2018/0015606 | A1 * | 1/2018 | Kurani | B25G 1/04 |
| 2019/0063009 | A1 * | 2/2019 | Mongelluzzo | E01C 23/0986 |
| 2020/0078924 | A1 * | 3/2020 | Cavaliere | B25G 1/04 |
| 2020/0156235 | A1 * | 5/2020 | Su | B25B 23/16 |
| 2020/0187633 | A1 * | 6/2020 | Paratore | F16B 7/1418 |
| 2020/0276695 | A1 * | 9/2020 | Buckley | A47L 13/50 |
| 2021/0016429 | A1 * | 1/2021 | Savard | A46B 5/0045 |
| 2021/0022327 | A1 * | 1/2021 | Barber | B25G 3/30 |
| 2021/0062528 | A1 * | 3/2021 | Newville | B25G 1/04 |
| 2021/0229260 | A1 * | 7/2021 | Howard | B25G 1/04 |
| 2021/0254344 | A1 * | 8/2021 | Holman | B25G 1/04 |

* cited by examiner

TELESCOPIC ALUMINUM ROD

CROSS-REFERENCE TO RELATED APPLICATIONS

This application claims priority to Chinese Patent Application No. 201920006431.7 with a filing date of Jan. 3, 2019. The content of the aforementioned application, including any intervening amendments thereto, are incorporated herein by reference.

TECHNICAL FIELD

The present disclosure relates to the technical field of cleaning apparatuses for a swimming pool, in particular to a telescopic aluminum rod.

BACKGROUND

Among the existing cleaning equipments for a swimming pool, on the constraint of depth of the swimming pool, a floor brush normally needs to be connected to a telescopic aluminum rod, making it more convenient for usage and storage. Furthermore, connection and disconnection of the current telescopic aluminum rod can be accomplished by first nesting several aluminum tubes and then locking by a locking mechanism. The locking mechanism is internally provided with bolts, and there is one or more insertion holes at the corresponding locations of the aluminum tubes whereby the adjacent aluminum tubes are locked into a whole through the bolts. Whereas, locking of a bolt depends on pressure from an elastic member, while its unlocking makes use of the lever principle, to be specific, the bolt is secured on one end of a bent plate, i.e., the other end of the bent plate is pressed to achieve unlocking. However, it requires more strength in unlocking and locking operations, thus it is neither easy nor convenient to use.

SUMMARY

As far as the above technical problems of the prior art, the present disclosure provides a telescopic aluminum rod that is convenient and easy to achieve locking and unlocking of adjacent aluminum tubes, for the purpose of overcoming the above technical defects.

The specific technical scheme is as follows:

A telescopic aluminum rod comprises at least two nested aluminum tubes; except the innermost aluminum tube, the rear ends of the rest aluminum tubes are respectively connected with a sleeve; each sleeve is internally provided with an accommodating cavity in which a locking device is arranged; the locking device comprises a pressing buckle which is longitudinally movably mounted in the accommodating cavity and the upper end face of the pressing buckle protrudes out of the sleeve through an opening formed on the sleeve, a bent plate of which the rear end abuts against the lower end face of the pressing buckle, and the middle is clamped inside the accommodating cavity, a bolt which is movably connected to the front end of the bent plate and the lower end of the bolt extends out of a hole slot formed on the inner bottom face in the accommodating cavity to a central channel of the sleeve; and except the outermost aluminum rod, the other aluminum tubes are respectively provided with at least one hole for the bolt to be inserted; an elastic piece with two ends abutting against the lower end face of the rear end of the bent plate and the inner bottom face of the accommodating cavity respectively.

Preferably, an annular groove is circumferentially formed on the upper end of each bolt, the front end of the bent plate is of a fork-shaped structure, and the bolt is movably connected to the front end of the bent plate through the clamped annular groove and fork-shaped structure. Preferably, the sleeve comprises a sleeve body, an accommodating cavity at one side of the sleeve body, and a cap arranged on the sleeve body for sealing the accommodating cavity; and the opening is formed on the cap. Preferably, the middle of the bent plate extends towards two sides to form two support plates in mirror symmetry; two symmetric supporting bases are formed by upward protrusion from the inner bottom face of the accommodating cavity; the upper end face of each supporting base sinks to form a groove for accommodating a support plate; the cap is provided with a protruding column extending downward and the lower end of the protruding column is embedded into the groove and abuts against the upper end surface of the middle of the bent plate.

Preferably, the lower end surface of the protruding column is of an arc-shaped structure.

Preferably, the lower end surface of the pressing buckle is also provided with two opposite limiting blocks extending downward, and the ends of the limiting blocks bend outwards; the outward-bent lower ends of the limiting blocks abut against the lower end face of the edge of the opening of the cap.

Preferably, the pressing buckle is also provided with an extension part formed by extending rearward; the lower end face of the extension part is provided with a slide bar placed transversely; a support seat is formed by bulging from the inner bottom face of the accommodating cavity; and the upper end surface of the support seat sinks inwards to form an arc-shaped groove for accommodating the slide bar.

Preferably, the number of the aluminum tubes is three and the rear end of the innermost aluminum tube is connected with a handle, while the rear ends of the other two aluminum tubes are respectively connected with a sleeve.

Preferably, each aluminum tube has a sliding groove extending along the length direction at its side; and a sliding rail matched with the sliding groove in structure is arranged on the inner side wall of the sleeve. Preferably, the elastic member is a spring.

Preferably, except the outmost aluminum tube, each of the other aluminum tubes is fixedly connected with a clearance adjusting sleeve at its periphery; the inner and outer side walls of each clearance adjusting sleeve cling to the inner and outer side walls of adjacent aluminum tubes separately.

Preferably, each clearance adjusting sleeve comprises two opposite clip sleeve of an arc-shaped plate structure, and the inner side of each clip sleeve is bulged to form a positioning pole; clamping holes that are matched with the positioning pole in shape and opposite to the positioning pole are arranged respectively in the circumferential wall of the innermost aluminum tube and in the circumferential wall of the middle aluminum tube.

The abovementioned technical scheme has the following beneficial effects that:

a. the telescopic aluminum rod comprises aluminum tubes, sleeves and locking devices, and the front end of the bent plate in the locking device is movably connected with a bolt while its middle is clamped into the accommodating cavity of the sleeve, thereby pressing down the pressing buckle and the rear end of the bent plate to drive the front end and the bolt to move upward under the effect of the lever principle so as to release the locking of adjacent aluminum tubes; furthermore, the elastic member automatically resets the bent plate after release, but the bolt downward extends into the holes of the adjacent aluminum tubes to achieve the locking of the adjacent aluminum tubes; the locking and unlocking of adjacent aluminum tubes are achieved in a convenient and easy way.

b. The bolt can disengage from the holes obliquely, without damage on the bolt and holes due to inaccurate hole positioning of the adjacent aluminum tubes, therefore, the unlocking and locking can be achieved in an easy manner, and when it's unlocked, the bolt is prevented from being damaged from violent rubbing with the aluminum tubes under an active state.

DETAILED DESCRIPTION OF THE EMBODIMENTS

Figure 1:
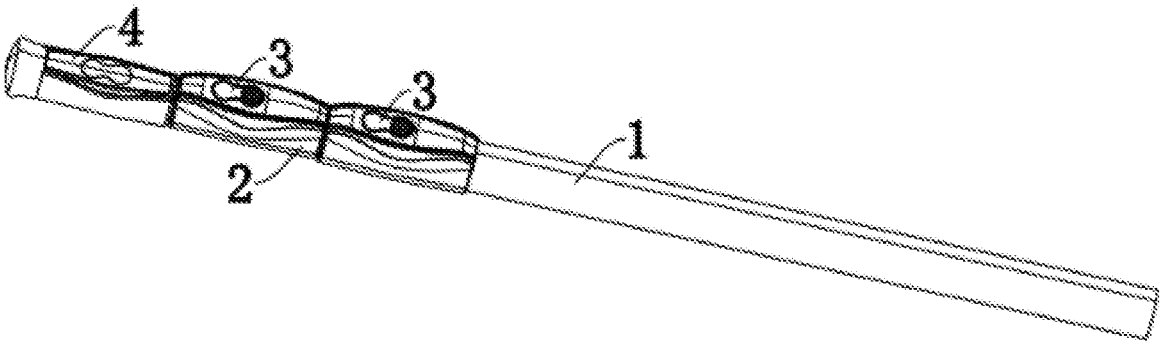
FIG. 1 is a perspective view of a telescopic aluminum rod of the present disclosure.
Figure 2:
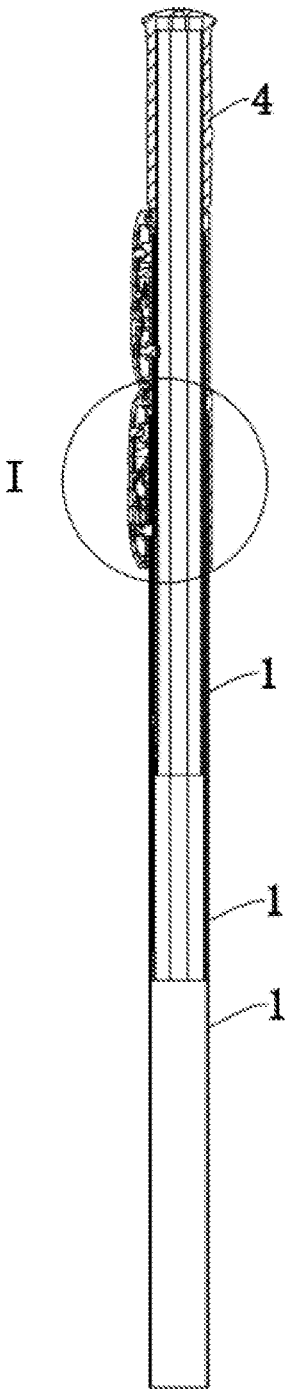
FIG. 2 is a diagram of the cross-section structure of the telescopic aluminum rod of the present disclosure.
Figure 3:
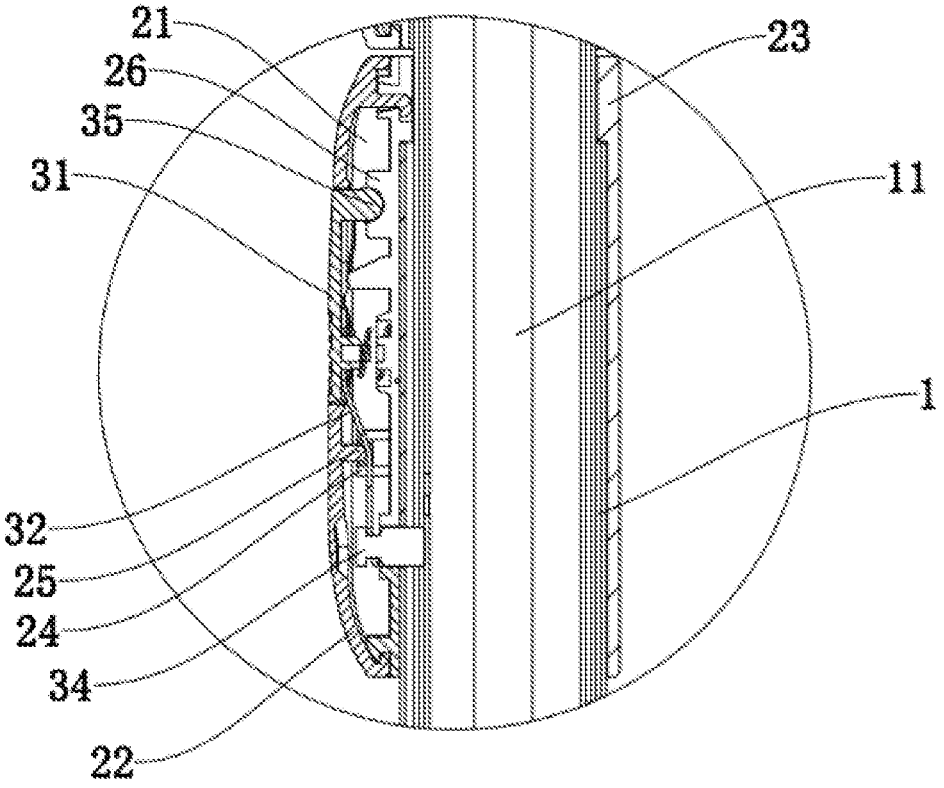
FIG. 3 is a partial-enlarged view of portion I in FIG. 2.
Figure 4:
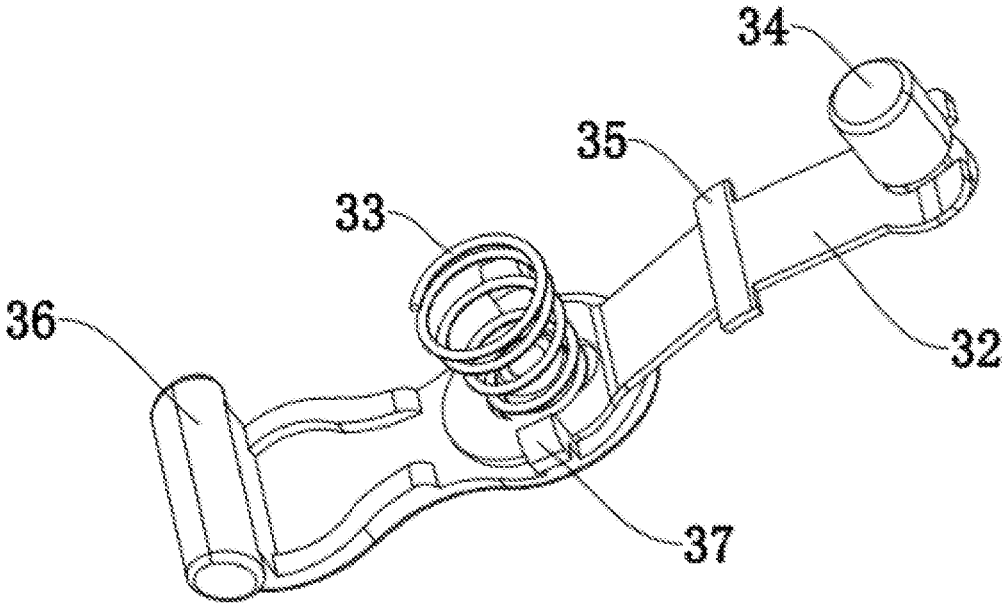
FIG. 4 is a perspective view of a locking device in the telescopic aluminum rod of the present disclosure.
Figure 5:
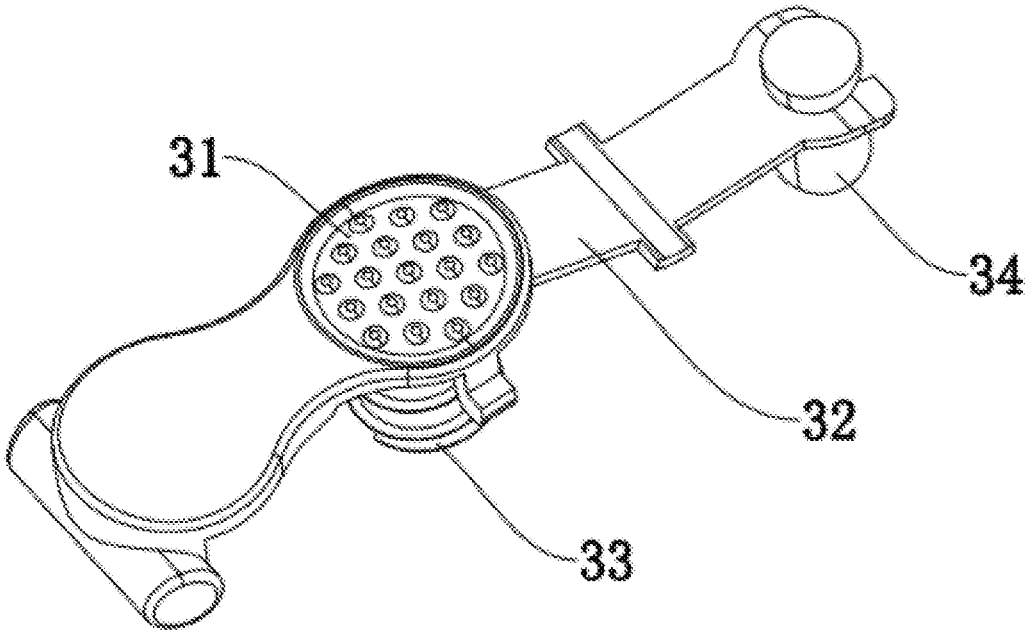
FIG. 5 is a perspective view of the locking device in the telescopic aluminum rod of the present disclosure, viewed from another angle.
Figure 6:
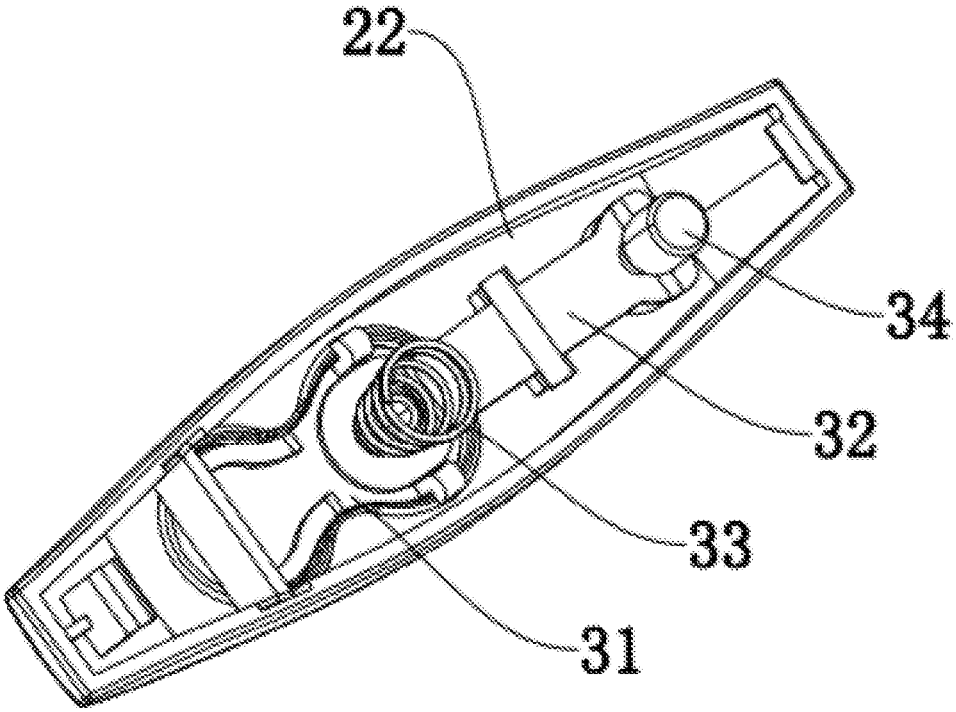
FIG. 6 is a perspective view showing the locking device in the telescopic aluminum rod of the present disclosure mounted on a sleeve.

For better illustration of the technical means, creative features, objects and effects of the present disclosure, explanations about the telescopic aluminum rod provided by the present disclosure will be given in detail in the following embodiments by referring to FIGS. 1-8. In addition, the direction along which an aluminum tube extends into its adjacent aluminum tube is defined as the front end, while the other end is the rear end.

Embodiment One

Referring to FIGS. 1-6, this embodiment provides a telescopic aluminum rod used on a cleaning apparatus for a swimming pool, comprising at least two nested aluminum tubes 1; except the innermost aluminum tube, the rear ends of the rest aluminum tubes 1 are respectively connected with a sleeve 2; each sleeve 2 is internally provided with an accommodating cavity 21 in which a locking device 3 is arranged; the locking device 3 comprises a pressing buckle 31 which is longitudinally movably mounted in the accommodating cavity 21 and of which the upper end face protrudes out of the sleeve 2 through an opening formed on the sleeve 2, a bent plate 32 of which the rear end abuts against the lower end face of the pressing buckle 31, and the middle is clamped inside the accommodating cavity 21, a bolt 34 which is movably connected to the front end of the bent plate 32 and of which the lower end extends out of a hole slot formed on the inner bottom face of the accommodating cavity 21 to a central channel of the sleeve 2; except the outermost one, the other aluminum tubes 1 are respectively provided with at least one hole into which the bolt 34 is inserted; an elastic member 33 with two ends abutting against the lower end face of the rear end of the bent plate 32 and the inner bottom face of the accommodating cavity 21 respectively.

Based on the above technical solution, the telescopic aluminum rod comprises aluminum tubes 1, sleeves 2 and locking devices 3. The front end of the bent plate 32 in the locking device 3 is movably connected with the bolt 34, and its middle is clamped into the accommodating cavity 21 of the sleeve 2, thereby pressing down the pressing buckle 31 and the rear end of the bent plate 32 to drive the front end and the bolt 34 to move upward under the effect of the lever principle so as to release locking of adjacent aluminum tubes 1. Furthermore, the elastic member 33 automatically resets the bent plate 32 after release, but the bolt 34 downward extends into the hole of the adjacent aluminum tube 1 to achieve locking of the adjacent aluminum tubes 1. In such a case, locking and unlocking of adjacent aluminum tubes 1 are achieved in a convenient and easy way.

In a preferred embodiment, an annular groove is circumferentially formed on the upper end of the bolt 34, the front end of the bent plate 32 is of a fork-shaped structure, and the bolt 34 is movably connected to the front end of the bent plate 32 through the clamped annular groove and fork-shaped structure. To be specific, the annular groove and the fork-shaped structure are relaxedly clamped such that the bolt 34 can do randomly free movement relative to the front end of the bent plate 32, therefore when the rear end of the bent plate 32 is pressed down, the bolt 34 can disengage from the hole in various ways, that is to say, with respect to a fixed bolt 34, the bolt 34 in this embodiment is capable of disengaging from the hole obliquely, without damage on the bolt 34 and the hole due to inaccurate hole positioning of adjacent aluminum tubes 1. In addition, it is needless to repeat the step of extending the bolt 34 into the hole, which operates in the same way. As can be seen, unlocking and locking become easy, and the bolt 34 is prevented from being damaged due to having violent friction with aluminum tubes 1 under an active state after unlocking.

As a further preferred embodiment, the sleeve 2 comprises a sleeve body 23, an accommodating cavity 21 at one side of the sleeve body 23, and a cap 22 arranged on the sleeve body 23 for sealing the accommodating cavity 21. An opening is formed on the cap 22. Further, the middle of the bent plate 32 extends towards two sides to form two support plates 35 in mirror symmetry. Two symmetric supporting bases 24 are formed through upward protrusion from the inner bottom face of the accommodating cavity 21. The upper end face of each supporting base 24 sinks to form a groove for accommodating a support plate 35. The cap 22 is provided with a protruding column 25 extending downward. The lower end of the protruding column 25 is embedded into the groove and abuts against the upper end face of the middle of the bent plate 32. Further, the lower end face of the protruding column 25 is of an arc-shaped structure such that the middle of the bent plate 32 is clamped between the supporting base 24 and the protruding column 25 and properly overturns. Further, the elastic member 33 is a spring or is made from a rubber part or other materials.

In a preferred embodiment, the lower end face of the pressing buckle 31 is also provided with two opposite limiting blocks 37 extending downward, and the ends of the limiting blocks 37 bend outwards; the outward-bent lower ends of the limiting blocks 37 abut against the lower end face of the edge of the opening of the cap 22 to prevent the pressing buckle 31 from disengaging from the opening under the effect of the elastic member 33. Further, the pressing buckle 31 is also provided with an extension part formed by extending rearward. The lower end face of the extension part has a slide bar 36 placed transversely. A support seat 26 is formed by bulging from the inner bottom face of the accommodating cavity 21. The upper end face of the support seat 26 sinks inwards to form an arc-shaped groove for accommodating the slide bar 36. Therefore, the slide bar 36 retains in the arc-shaped groove and properly rotates to adapt to vertical movement of the front portion of the pressing buckle 31. Further, the length of the slide bar 36 is more than the width of the opening, and two ends of the slide bar 36 abut against the lower surface of the cap 22 to limit the slide bar 36 inside the arc-shaped groove and thus prevent disengagement.

In a preferred embodiment, there are three aluminum tubes 1. The rear end of the innermost aluminum tube 1 is connected with a handle 4, while the rear ends of the other two are respectively connected with a sleeve 2. Further, each aluminum tube 1 has a sliding groove 11 extending along the length direction at its side. A sliding rail matched with the sliding groove 11 in structure is arranged on the inner side wall of the sleeve 2 to prevent radial movement of the aluminum tubes 1 in the retracting process. Further, the rear ends of the aluminum tubes 1 are inserted inside the sleeve 2, and another through hole for the bolt 34 to pass through is also formed on the aluminum tube 1 to make the structure steady. It is also permissible that the front end of the sleeve 2 is directly connected to the rear end of another sleeve 2. When in specific use, as long as the pressing buckle 31 is pressed down, the front portion of the pressing buckle 31 overturns relative to its rear portion, and drives the rear end of the bent plate 32 and the elastic member 33 to move downward, under the effect of the lever principle, the front end of the bent plate 32 and the movably connected bolt 34 release locking of the aluminum tubes 1 inside, at this moment, adjacent aluminum tubes 1 can be retracted. Relative locking operation also operates in the same way, thus the repetition of description is omitted.

Embodiment Two

Figure 7:
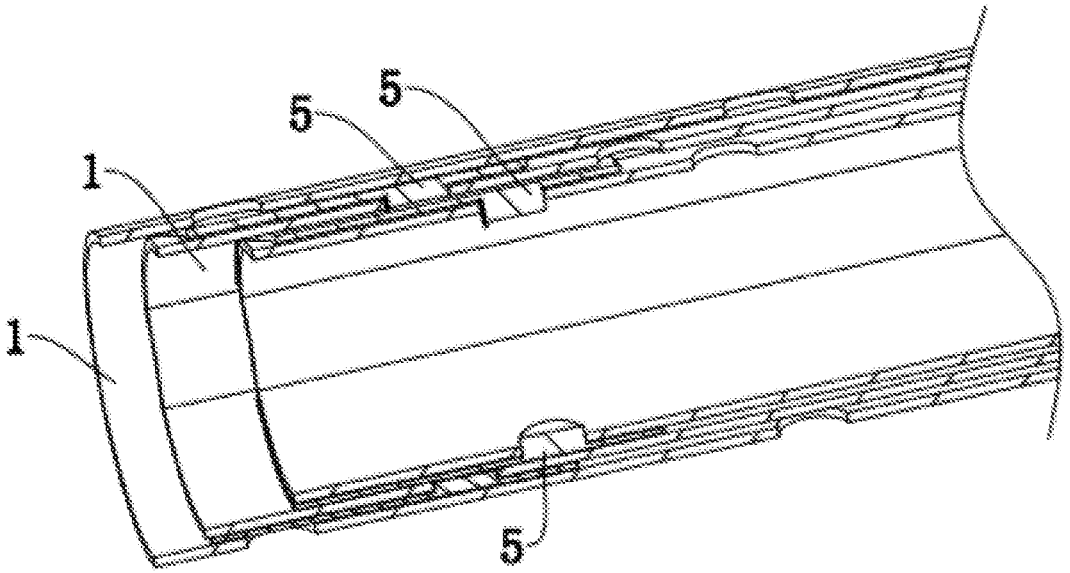
FIG. 7 is a perspective view of a section of clearance adjusting sleeves arranged among aluminum tubes in another embodiment of the telescopic aluminum rod of the present disclosure.
Figure 8:
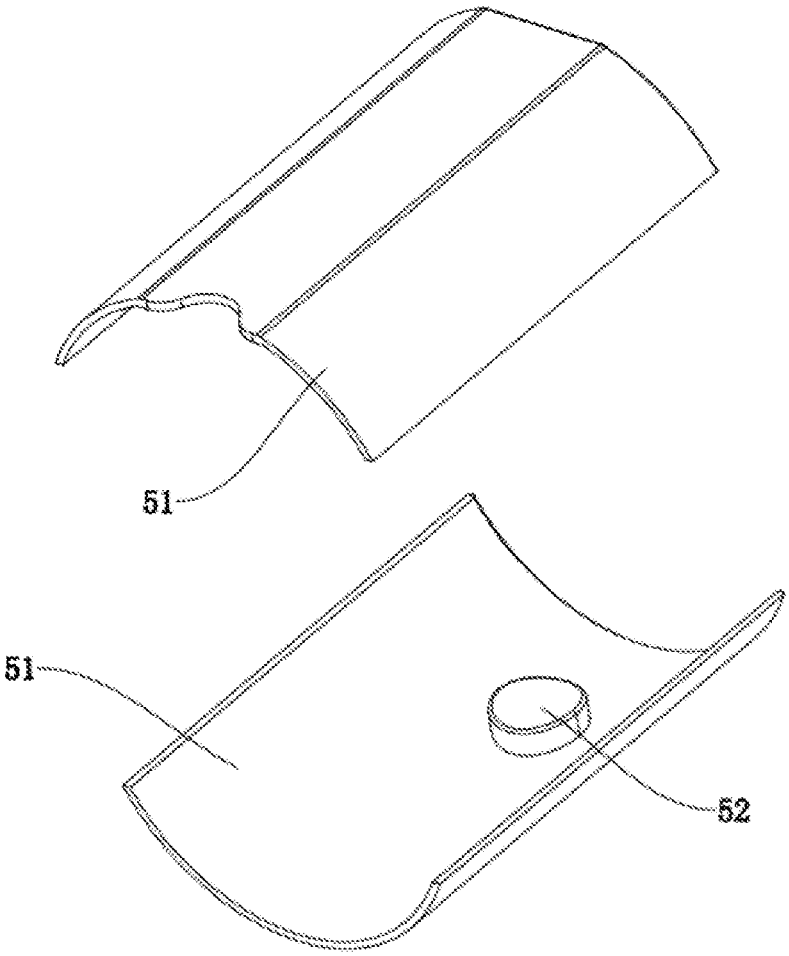
FIG. 8 is a perspective view of the clearance adjusting sleeve in another embodiment of the telescopic aluminum rod of the present disclosure.

Referring to FIGS. 7 and 8, the telescopic aluminum rod provided in this embodiment has the substantially same structure and contents to that in Embodiment One. The only difference lies in that except the outmost aluminum tube, each of the other aluminum tubes 1 is fixedly connected with a clearance adjusting sleeve 5 at its periphery. The inner and outer side walls of each clearance adjusting sleeve 5 cling to the inner and outer side walls of adjacent aluminum tubes 1 separately. When in specific use, there are three nested aluminum tubes 1. Both at the periphery of the front end of the innermost aluminum tube 1 and at the periphery of the front end of the middle aluminum tube 1, there provide the clearance adjusting sleeves 5, and the two clearance adjusting sleeves 5 are respectively arranged among the nested three aluminum tubes 1 to ensure steadiness in use, reduce oscillation among the aluminum tubes, and make the whole structure more compact. Further, each clearance adjusting sleeve 5 comprises two opposite clip sleeves 51 of an arc-shaped plate structure, and the inner side of each clip sleeve 51 is bulged to form a positioning pole 52; clamping holes that are matched with the positioning pole in shape and opposite to the positioning pole are arranged respectively in the circumferential wall of the innermost aluminum tube 1 and in the circumferential wall of the middle aluminum tube 1. The positioning pole and the clamping holes are used for clamping the clip sleeve thereon.

The above merely provides the preferred embodiments of the present disclosure, which is illustrative, rather than restrictive, to the present invention. It should be understood by those skilled in the art that, many variations, modifications even substitutions that do not depart from the spirit and scope defined by the present disclosure, shall fall into the extent of protection of the present disclosure.

We claim:

1. A telescopic aluminum rod, comprising at least two nested aluminum tubes and except the innermost aluminum tube, the rear ends of the rest aluminum tubes are respectively connected with a sleeve; each sleeve is internally provided with an accommodating cavity in which a locking device is arranged; wherein the locking device comprises:

a pressing buckle, and the pressing buckle is longitudinally movably mounted in the accommodating cavity and the upper end face of the pressing buckle protrudes out of the sleeve through an opening formed on the sleeve, a bent plate, and the rear end of the bent plate abuts against the lower end face of the pressing buckle, and the middle is clamped inside the accommodating cavity, a bolt, and the bolt is movably connected to the front end of the bent plate and the lower end of the bolt extends out of a hole slot formed on the inner bottom face in the accommodating cavity to a central channel of the sleeve; and except the outermost aluminum rod, the other aluminum tubes are respectively provided with at least one hole for the bolt to be inserted; and an elastic piece; the two ends of the elastic piece abut against the lower end face of the rear end of the bent plate and the inner bottom face of the accommodating cavity respectively.

2. The telescopic aluminum rod of claim 1, wherein an annular groove is circumferentially formed on the upper end of each bolt, the front end of the bent plate is of a fork-shaped structure, and the bolt is movably connected to the front end of the bent plate through the clamped annular groove and fork-shaped structure.

3. The telescopic aluminum rod of claim 1, wherein the sleeve comprises a sleeve body, an accommodating cavity at one side of the sleeve body, and a cap arranged on the sleeve body for sealing the accommodating cavity; and the opening is formed on the cap.

4. The telescopic aluminum rod of claim 3, wherein the middle of the bent plate extends towards two sides to form two support plates in mirror symmetry; two symmetric supporting bases are formed by upward protrusion from the inner bottom face of the accommodating cavity; the upper end face of each supporting base sinks to form a groove for accommodating a support plate; the cap is provided with a protruding column extending downward and the lower end of the protruding column is embedded into the groove and abuts against the upper end surface of the middle of the bent plate.

5. The telescopic aluminum rod of claim 4, wherein the lower end surface of the protruding column is of an arc-shaped structure.

6. The telescopic aluminum rod of claim 3, wherein the lower end surface of the pressing buckle is also provided with two opposite limiting blocks extending downward, and the ends of the limiting blocks bend outwards; the outward-bent lower ends of the limiting blocks abut against the lower end face of the edge of the opening of the cap.

7. The telescopic aluminum rod of claim 1, wherein the pressing buckle is also provided with an extension part formed by extending rearward; the lower end face of the extension part is provided with a slide bar placed transversely; a support seat is formed by bulging from the inner bottom face of the accommodating cavity; and the upper end surface of the support seat sinks inwards to form an arc-shaped groove for accommodating the slide bar.

8. The telescopic aluminum rod of claim 1, wherein the number of the aluminum tubes is three and the rear end of the innermost aluminum tube is connected with a handle, and the rear ends of the other two aluminum tubes are respectively connected with a sleeve.

9. The telescopic aluminum rod of claim 8, wherein each aluminum tube has a sliding groove extending along the length direction at its side; and a sliding rail matched with the sliding groove in structure is arranged on the inner side wall of the sleeve.

10. The telescopic aluminum rod of claim 1, wherein the elastic member is a spring.

11. The telescopic aluminum rod of claim 1, wherein except the outmost aluminum tube, each of the other aluminum tubes is fixedly connected with a clearance adjusting sleeve at its periphery; the inner and outer side walls of each clearance adjusting sleeve cling to the inner and outer side walls of adjacent aluminum tubes separately.

12. The telescopic aluminum rod of claim 11, wherein each clearance adjusting sleeve comprises two opposite clip sleeve of an arc-shaped plate structure, and the inner side of each clip sleeve is bulged to form a positioning pole; clamping holes that are matched with the positioning pole in shape and opposite to the positioning pole are arranged respectively in the circumferential wall of the innermost aluminum tube and in the circumferential wall of the middle aluminum tube.

13. The telescopic aluminum rod of claim 5, wherein the lower end surface of the pressing buckle is also provided with two opposite limiting blocks extending downward, and the ends of the limiting blocks bend outwards; the outward-bent lower ends of the limiting blocks abut against the lower end face of the edge of the opening of the cap.

14. The telescopic aluminum rod of claim 4, wherein the pressing buckle is also provided with an extension part formed by extending rearward; the lower end face of the extension part is provided with a slide bar placed transversely; a support seat is formed by bulging from the inner bottom face of the accommodating cavity; and the upper end surface of the support seat sinks inwards to form an arc-shaped groove for accommodating the slide bar.

* * * * *